US012448757B2

(12) United States Patent
Onishi et al.

(10) Patent No.: US 12,448,757 B2
(45) Date of Patent: Oct. 21, 2025

(54) CONSTRUCTION METHOD AND CONSTRUCTION SYSTEM

(71) Applicant: Komatsu Ltd., Tokyo (JP)

(72) Inventors: Yoshiyuki Onishi, Tokyo (JP); Mitsuhiro Aoki, Tokyo (JP); Masahiro Kurihara, Tokyo (JP); Kenjiro Shimada, Tokyo (JP); Toyohito Uchizono, Tokyo (JP)

(73) Assignee: KOMATSU LTD., Tokyo (JP)

( * ) Notice: Subject to any disclaimer, the term of this patent is extended or adjusted under 35 U.S.C. 154(b) by 472 days.

(21) Appl. No.: 17/918,372

(22) PCT Filed: Apr. 2, 2021

(86) PCT No.: PCT/JP2021/014333
§ 371 (c)(1),
(2) Date: Oct. 12, 2022

(87) PCT Pub. No.: WO2021/210427
PCT Pub. Date: Oct. 21, 2021

(65) Prior Publication Data

US 2023/0143733 A1 May 11, 2023

(30) Foreign Application Priority Data

Apr. 14, 2020 (JP) ..... 2020-072476

(51) Int. Cl.
*E02F 9/26* (2006.01)
*E02F 9/20* (2006.01)

(52) U.S. Cl.
CPC ..... *E02F 9/262* (2013.01); *E02F 9/205* (2013.01); *E02F 9/265* (2013.01)

(58) Field of Classification Search
CPC . E02F 9/262; E02F 9/205; E02F 9/265; E02F 3/435; E02F 9/2033; E02F 9/2054
See application file for complete search history.

(56) References Cited

U.S. PATENT DOCUMENTS 9,493,929 B2 11/2016 Kurihara et al.
9,834,905 B2 12/2017 Matsuyama et al.
(Continued)

FOREIGN PATENT DOCUMENTS

CN 104246085 A 12/2014
CN 104781478 A 7/2015
(Continued)

*Primary Examiner* — Khoi H Tran
*Assistant Examiner* — Tristan J Greiner
(74) *Attorney, Agent, or Firm* — Troutman Pepper Locke LLP

(57) ABSTRACT

In a construction method using an excavator that is controlled by manual operation, and an excavator that includes an automatic working-equipment control unit automatically controlling second working equipment on the basis of at least one of a current terrain and a designed terrain of a construction range in a construction site, and a tooth-edge position of the second working equipment, a progress rate that indicates a volume of soil having been excavated by the excavator to a target volume of soil to be excavated by the excavator in the construction range is calculated, and when the progress rate is equal to or larger than a threshold, the excavator stops construction of the construction range, and the excavator takes over the construction of the construction range, from the excavator.

9 Claims, 8 Drawing Sheets

(56) References Cited

U.S. PATENT DOCUMENTS

| | | | | |
|---|---|---|---|---|
| 10,017,919 | B2 | 7/2018 | Nomura et al. | |
| 10,975,551 | B2 | 4/2021 | Uji et al. | |
| 11,149,411 | B2 | 10/2021 | Edamura et al. | |
| 11,250,623 | B2 | 2/2022 | Shike et al. | |
| 11,427,984 | B2 | 8/2022 | Roh et al. | |
| 11,613,873 | B2 | 3/2023 | Sano et al. | |
| 11,788,253 | B2 | 10/2023 | Sano et al. | |
| 2002/0059320 | A1 | 5/2002 | Tamaru | |
| 2016/0024757 | A1 | 1/2016 | Nomura et al. | |
| 2016/0312446 | A1* | 10/2016 | Pettersson | E02F 3/76 |
| 2017/0089033 | A1 | 3/2017 | Matsuyama et al. | |
| 2017/0167116 | A1* | 6/2017 | Fujii | E02F 3/425 |
| 2017/0247861 | A1 | 8/2017 | Matsuyama et al. | |
| 2018/0137446 | A1 | 5/2018 | Shike et al. | |
| 2018/0202128 | A1 | 7/2018 | Kurakane et al. | |
| 2018/0374168 | A1 | 12/2018 | Kano et al. | |
| 2019/0017249 | A1 | 1/2019 | Uji et al. | |
| 2019/0390442 | A1* | 12/2019 | Metzger | E02F 9/262 |
| 2020/0011029 | A1 | 1/2020 | Sano et al. | |
| 2020/0018045 | A1 | 1/2020 | Sano et al. | |
| 2020/0173791 | A1 | 6/2020 | Misaki | |
| 2020/0256034 | A1* | 8/2020 | Yamamoto | E02F 9/2228 |
| 2020/0277753 | A1 | 9/2020 | Roh et al. | |
| 2020/0277758 | A1 | 9/2020 | Edamura et al. | |
| 2021/0010229 | A1* | 1/2021 | Sano | E02F 9/2292 |
| 2021/0034058 | A1* | 2/2021 | Subramanian | G06T 17/05 |
| 2021/0142557 | A1 | 5/2021 | Shike et al. | |

FOREIGN PATENT DOCUMENTS

| | | | |
|---|---|---|---|
| CN | 105518222 | A | 4/2016 |
| CN | 108475399 | A | 8/2018 |
| CN | 108713084 | A | 10/2018 |
| CN | 108797669 | A | 11/2018 |
| CN | 110382788 | A | 10/2019 |
| CN | 110382793 | A | 10/2019 |
| CN | 110446817 | A | 11/2019 |
| CN | 110546674 | A | 12/2019 |
| CN | 110799708 | A | 2/2020 |
| JP | 2002-188183 | A | 7/2002 |
| JP | 2012-172431 | A | 9/2012 |
| JP | 2017-008719 | A | 1/2017 |
| JP | 2019-015176 | A | 1/2019 |
| JP | 2019-159727 | A | 9/2019 |
| JP | 2019-215672 | A | 12/2019 |
| WO | 2016/111384 | A1 | 7/2016 |
| WO | 2016/208276 | A1 | 12/2016 |
| WO | 2017/115879 | A1 | 7/2017 |
| WO | 2019/189503 | A1 | 10/2019 |

* cited by examiner

CONSTRUCTION METHOD AND CONSTRUCTION SYSTEM

FIELD

The present disclosure relates to a construction method and a construction system.

BACKGROUND

In work machines such as excavators and bulldozers, work machines have widely used, each of which has a guide display function of displaying a guide indicating at least a current terrain or designed terrain of a construction range or a tooth-edge position of the work machine, or an automatic control function of automatically controlling working equipment (or intervention control in the operation of an operator) on the basis of the current terrain and the designed terrain of the construction range and position information about the work machine (e.g., see Patent Literatures 1 to 3).

CITATION LIST

Patent Literature

Patent Literature 1: JP 2012-172431 A
Patent Literature 2: WO 2016/111384 A
Patent Literature 3: WO 2017/115879 A

SUMMARY

Technical Problem

Although use of the work machines having the automatic control functions makes construction more efficient, there is room for improvement in efficiency. In addition, the work machines having the automatic control functions are relatively expensive to general work machines. Therefore, it is desired to suppress the number of the work machines having the automatic control functions used, for further improvement in construction efficiency.

The present disclosure has been made in view of the above, and an object of the present disclosure is to provide a construction method and a construction system that are configured to improve construction efficiency by using a work machine controlled by manual operation and a work machine having an automatic control function.

Solution to Problem

According to an aspect of the present invention, a construction method uses: a first work machine that is controlled by manual operation; and a second work machine that includes an automatic working-equipment control unit automatically controlling second working equipment based on at least one of a current terrain and a designed terrain of a construction range, and a tooth-edge position of the second working equipment, the construction method comprises: calculating a progress rate in the construction range for the first work machine based on the current terrain and the designed terrain of the construction range for the first work machine; and when the progress rate is equal to or larger than a threshold, the first work machine stops construction of the construction range, and the second work machine takes over the construction of the construction range from the first work machine.

According to an aspect of the present invention, a construction system uses: a first work machine that is controlled by manual operation; and a second work machine that includes an automatic working-equipment control unit automatically controlling second working equipment based on at least one of a current terrain and a designed terrain of a construction range, and a tooth-edge position of the second working equipment, the construction system comprises: a storage unit that stores the designed terrain of the construction range for the first work machine; an acquisition unit that acquires construction result data indicating a result of construction of the construction range for the first work machine; a progress rate calculation unit that calculates a progress rate of construction by the first work machine, based on the designed terrain of the construction range for the first work machine stored in the storage unit and the construction result data acquired by the acquisition unit; and an instruction unit that instructs the first work machine to stop construction of the construction range and that instructs the second work machine to take over the construction of the construction range, when the progress rate calculated by the progress rate calculation unit is equal to or larger than a threshold.

Advantageous Effects of Invention

According to an aspect of the present invention, it is possible to improve the construction efficiency by using the work machine controlled by manual operation and the work machine having the automatic control function.

DESCRIPTION OF EMBODIMENTS

Embodiments of a construction method and a construction system according to the present invention will be described below with reference to the drawings. Note that the present invention is not limited to the embodiments. In addition, component elements in the following embodiments include component elements that are easily replaceable by those skilled in the art or that are substantially equivalent.

<Construction System>

Figure 1:
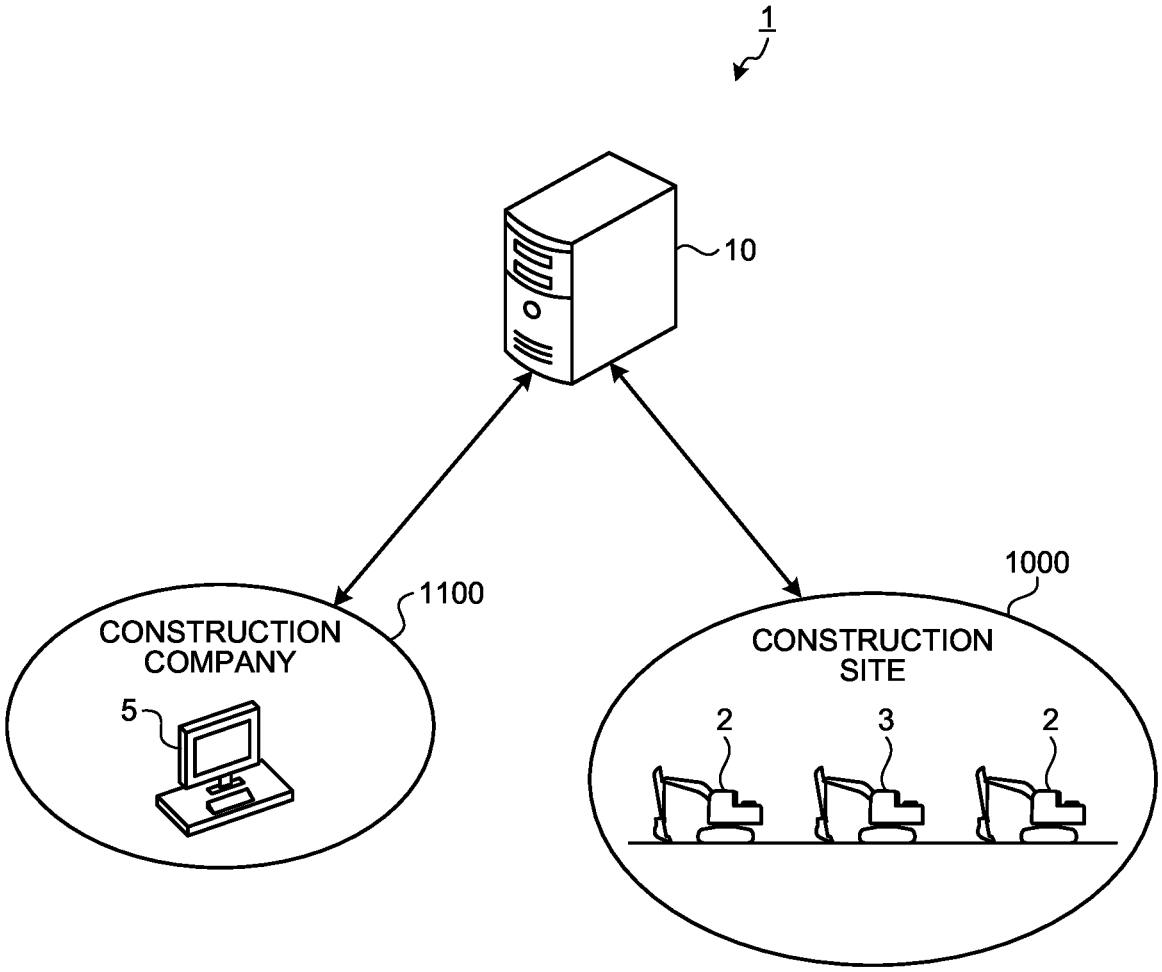
FIG. 1 is a schematic diagram illustrating an example of a construction system according to the present embodiment.
Figure 2:
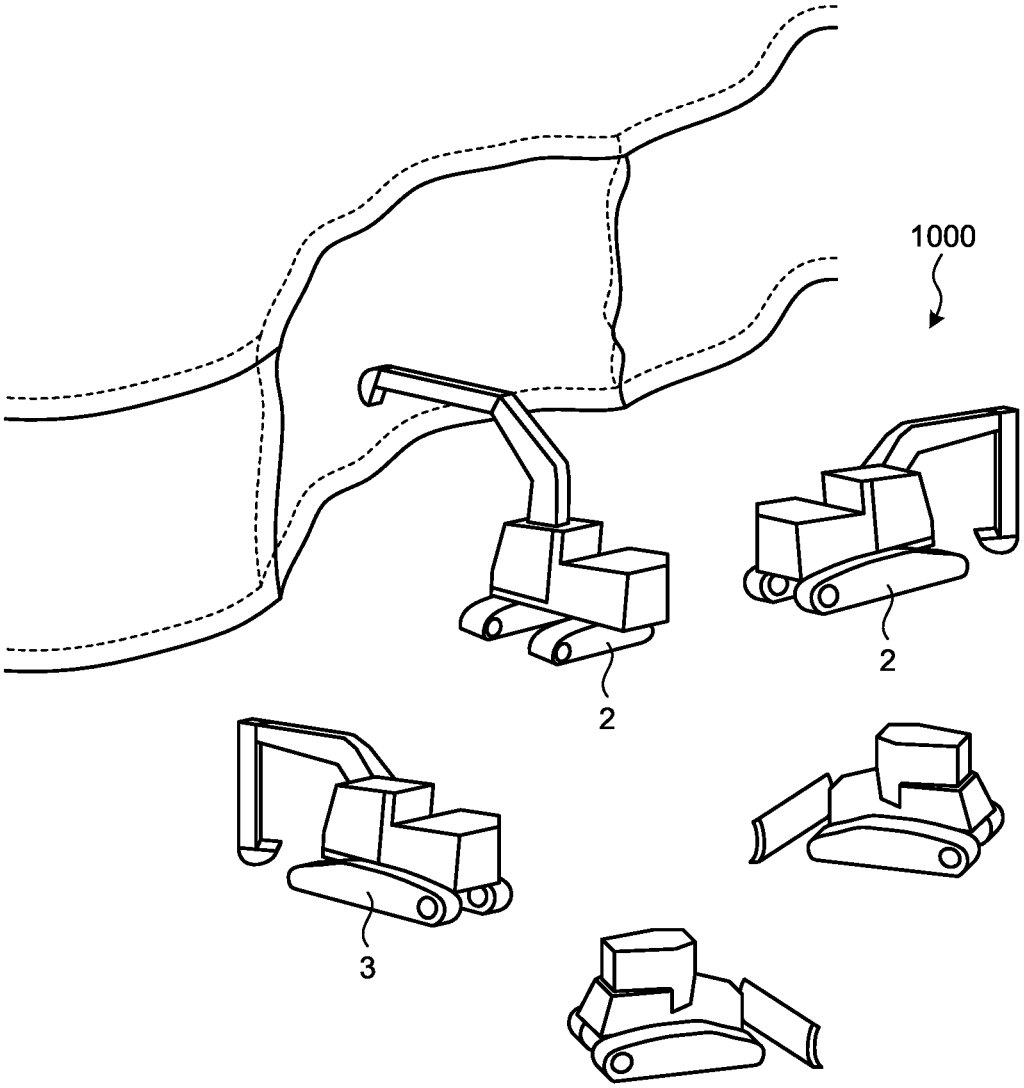
FIG. 2 is a schematic diagram illustrating an example of a construction range to which the construction system according to the present embodiment is applied.

FIG. 1 is a schematic diagram illustrating an example of the construction system according to the present embodiment. FIG. 2 is a schematic diagram illustrating an example of a construction range to which the construction system according to the present embodiment is applied. A construction system 1 uses an excavator 2 as a first work machine whose working equipment is operated by an operator, and an excavator 3 as a second work machine that is automatically controlled. More specifically, the construction system 1 includes a plurality of first work machines 2 operating in a construction site 1000, one or more second work machines 3 operating in the construction site 1000, an information terminal 5 installed in a construction company 1100, and a server device 10. In the construction site 1000, the construction range is assigned to each of the plurality of first work machines 2 to perform construction.

<First Work Machine>

Figure 3:
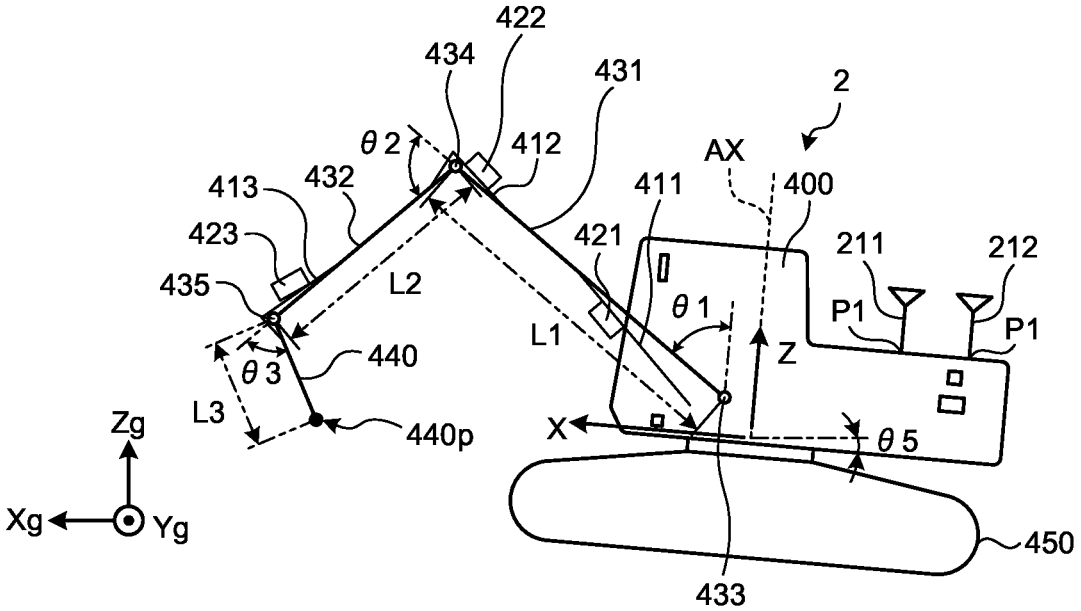
FIG. 3 is a schematic diagram illustrating an excavator as a first work machine according to the present embodiment.
Figure 4:
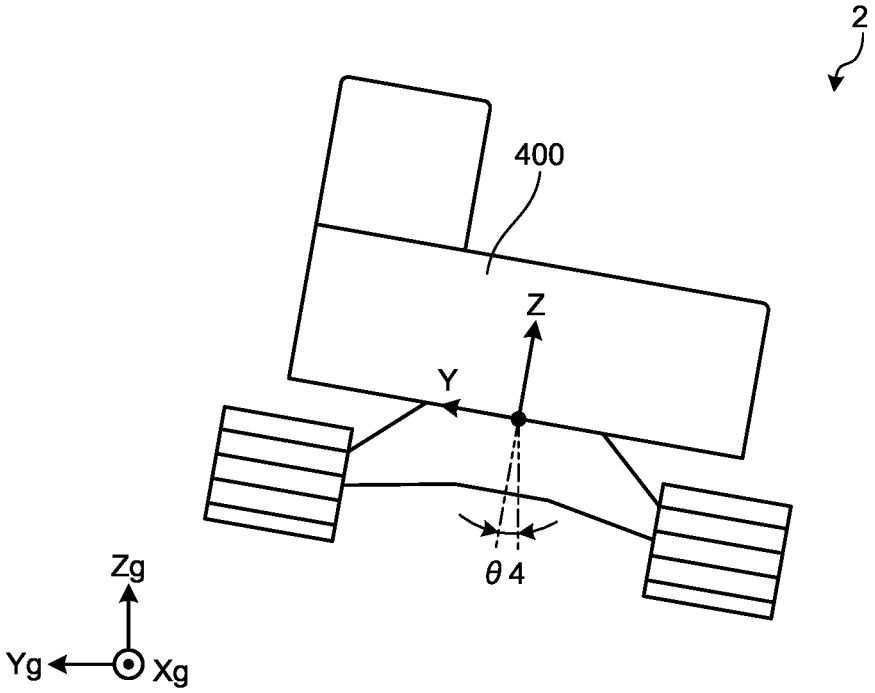
FIG. 4 is a schematic diagram illustrating the excavator as the first work machine according to the present embodiment.
Figure 5:
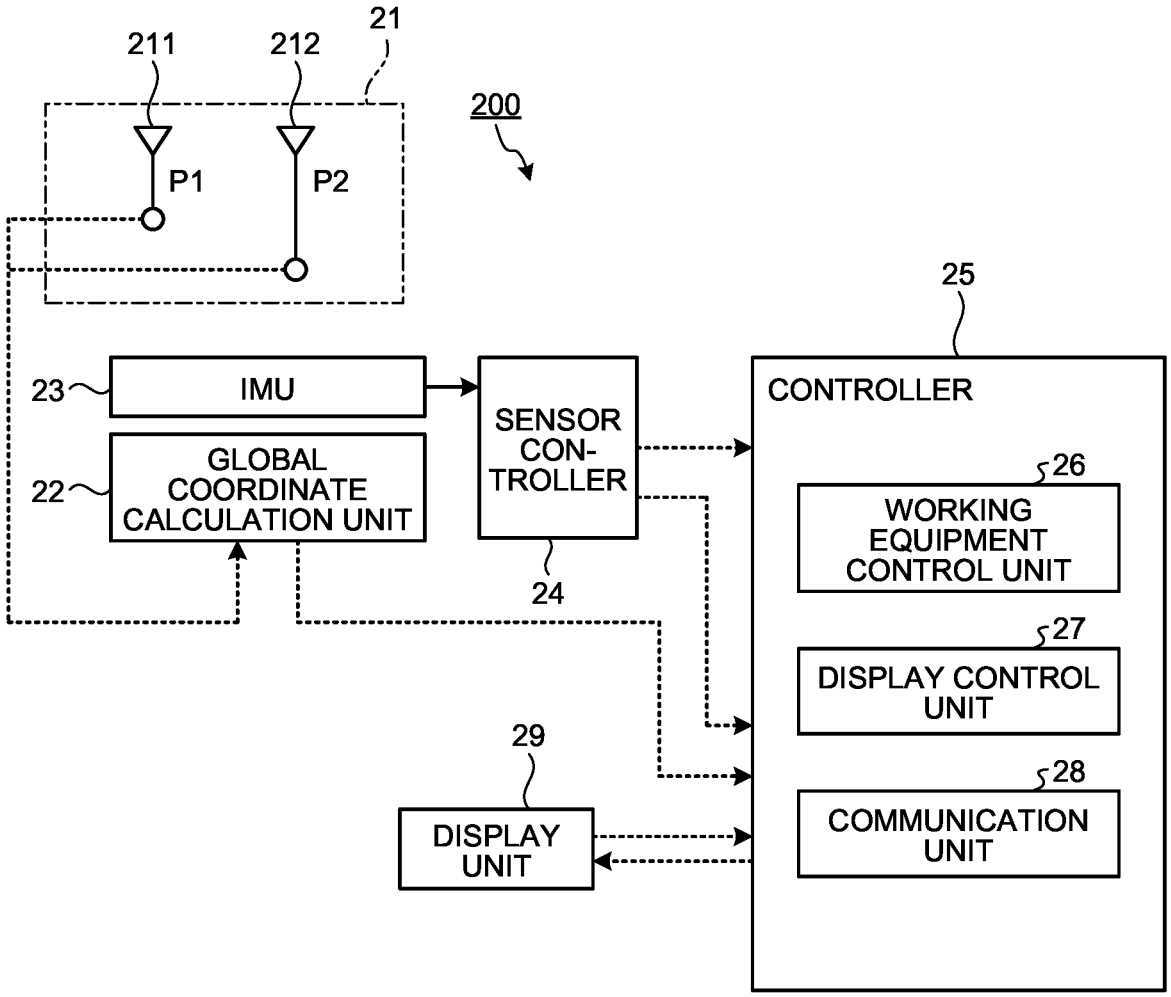
FIG. 5 is a block diagram illustrating the excavator as the first work machine according to the present embodiment.

FIG. 3 is a schematic diagram illustrating the excavator as the first work machine according to the present embodiment. FIG. 4 is a schematic diagram illustrating the excavator as the first work machine according to the present embodiment. FIG. 5 is a block diagram illustrating the excavator as the first work machine according to the present embodiment. The first work machine 2 is a work machine having the working equipment (first working equipment), such as an excavator, a bulldozer, or a wheel loader. The first work machine 2 is controlled by manual operation. In the first work machine 2, the working equipment is configured to be controlled only by manual operation, and no automatic control function of automatically controlling the working equipment is provided. The first work machine 2 desirably has a guide display function of displaying a guide indicating at least a current terrain or designed terrain of the construction range, or a tooth-edge position of the working equipment. The first work machine 2 may not have the guide display function. In the present embodiment, the excavator 2 will be described as an example of the first work machine. The excavator 2 includes a vehicle body 400 and the working equipment. In the excavator 2, the working equipment is operated by the operator. In the present embodiment, the excavator 2 has the guide display function. The excavator 2 includes a display unit 29 that displays a guide indicating at least the current terrain or the designed terrain of the construction range in the construction site 1000, the construction range being a construction target of the excavator 2, and the tooth-edge position of the working equipment.

The excavator 2 includes a boom 431 that is connected to the vehicle body 400 via a boom pin 433, and an arm 432 that is connected to the boom 431 via an arm pin 434. A bucket 440 is connected to the arm 432 via a bucket pin 435.

A length of the boom 431, that is, a length between the boom pin 433 and the arm pin 434 is L1. A length of the arm 432, that is, a length between the arm pin 434 and the bucket pin 435 is L2. A length of the bucket 440, that is, a length between the bucket pin 435 and a tooth edge 440*p* of the bucket 440 is L3.

The excavator 2 includes a boom cylinder 411 that drives the boom 431, an arm cylinder 412 that drives the arm 432, a bucket cylinder 413 that drives the bucket 440, a boom cylinder stroke sensor 421 that detects an amount of movement of the boom cylinder 411, an arm cylinder stroke sensor 422 that detects an amount of movement of the arm cylinder 412, and a bucket cylinder stroke sensor 423 that detects an amount of movement of the bucket cylinder 413. The boom cylinders 411, the arm cylinder 412, and the bucket cylinder 413 are a hydraulic cylinder. The boom cylinder stroke sensor 421 detects boom cylinder length data that indicates a stroke length of the boom cylinder 411. The arm cylinder stroke sensor 422 detects arm cylinder length data that indicates a stroke length of the arm cylinder 412. The bucket cylinder stroke sensor 423 detects bucket cylinder length data that indicates a stroke length of the bucket cylinder 413.

The vehicle body 400 of the excavator 2 is supported by an undercarriage 450. The vehicle body 400 is an upper swing body that is swingable about a swing axis AX. The vehicle body 400 includes a cab provided with a driver's seat on which a driver sits.

The undercarriage 450 includes a crawler track. The tooth edge 440*p* is positioned at an end of the bucket 440. In land grading and land cutting (excavation work), the tooth edge 440*p* comes into contact with the ground of the construction site 1000.

An antenna 211 and an antenna 212 are mounted to the excavator 2. The antenna 211 and the antenna 212 are used to detect a current position of the excavator 2. The antenna 211 and the antenna 212 are electrically connected to a position detection device 21 that is a position detection unit for detecting the current position of the excavator 2.

The excavator 2 includes a control system 200 that includes the position detection device 21, a global coordinate calculation unit 22, an inertial measurement unit (IMU) 23, a sensor controller 24, a controller 25, and the display unit 29.

The position detection device 21 detects an absolute position of the work machine. The position detection device 21 uses real time kinematic-global navigation satellite systems (RTK-GNSS, GNSS represents global navigation satellite system) to detect the current position of the excavator 2. In the following description, the antenna 211 and the antenna 212 will be appropriately referred to a GNSS antenna 211 and a GNSS antenna 212. Signals according to GNSS radio waves received by the GNSS antenna 211 and the GNSS antenna 212 are input to the position detection device 21. The position detection device 21 detects installation positions of the GNSS antenna 211 and the GNSS antenna 212. The position detection device 21 includes, for example, a three-dimensional position sensor.

The position detection device 21 includes the GNSS antenna 211 and the GNSS antenna 212 which are described above. Signals according to the GNSS radio waves received by the GNSS antenna 211 and the GNSS antenna 212 are input to the global coordinate calculation unit 22. The GNSS antenna 211 receives reference position data P1 indicating a position of the GNSS antenna 211, from a positioning satellite. The GNSS antenna 212 receives reference position data P2 indicating a position of the GNSS antenna 212, from the positioning satellite. The GNSS antenna 211 and the GNSS antenna 212 receive the reference position data P1 and the reference position data P2 at a predetermined interval. The reference position data P1 and the reference position data P2 are information about positions where the GNSS antennas are installed. Whenever receiving the reference position data P1 and the reference position data P2, the GNSS antenna 211 and the GNSS antenna 212 output the data to the global coordinate calculation unit 22.

The global coordinate calculation unit 22 calculates position information about the work machine in a global coordinate system (XgYgZg coordinate system), from a result of the detection by the position detection device 21. The global coordinate calculation unit 22 includes storage units such as RAM and ROM, and a processing unit such as CPU. The global coordinate calculation unit 22 generates swing body arrangement data indicating arrangement of the upper swing body of the excavator 2, on the basis of the two pieces of reference position data P1 and P2. In the present embodiment, the swing body arrangement data includes reference position data that is one of the two pieces of reference position data P1 and P2 and swing body orientation data that is generated on the basis of the two pieces of reference position data P1 and P2. The swing body orientation data indicates an orientation in which the working equipment of the excavator 2 faces. The global coordinate calculation unit 22 updates the swing body arrangement data, that is, the reference position data and the swing body orientation data whenever acquiring the two pieces of reference position data P1 and P2 from the GNSS antenna 211 and the GNSS antenna 212 at the predetermined interval, and outputs the swing body orientation data to a display control unit 27.

The IMU 23 detects an angular velocity and acceleration of the excavator 2. The excavator 2 generates various accelerations, such as an acceleration generated during traveling, an angular acceleration generated during turning, and a gravitational acceleration, are generated with the movement thereof, but the IMU 23 detects and outputs at least the gravitational acceleration. Here, the gravitational acceleration is acceleration corresponding to drag force to gravity. The IMU 23 detects accelerations in the Xg-axis direction, the Yg-axis direction, and the Zg-axis direction, and angular velocities (rotation angular velocities) around the Xg-axis, the Yg-axis, and the Zg-axis, for example, in the global coordinate system. The IMU 23 outputs information acquired to the sensor controller 24.

The inertial measurement unit (IMU) 24 is connected to the sensor controller 24. The IMU 23 is provided in the vehicle body 400. The IMU 23 acquires vehicle body inclination information such as pitch around the Yg axis and roll around the Xg axis of the excavator 2, and outputs the information to the sensor controller 24. The IMU 23 detects an inclination angle θ4 of the vehicle body 400 in a left-right direction and an inclination angle θ5 of the vehicle body 400 in a front-rear direction.

The sensor controller 24 includes storage units such as a random access memory (RAM) and a read only memory (ROM), and a processing unit such as a central processing unit (CPU). The sensor controller 24 calculates an inclination angle θ1 of the boom 431 relative to a direction (Z-axis direction) orthogonal to a local coordinate system (XYZ coordinate system) of the excavator 2, specifically, orthogonal to a horizontal plane (XY plane) in the local coordinate system of the vehicle body 400, on the basis of the boom cylinder length detected by the boom cylinder stroke sensor 421, and outputs the inclination angle θ1 to a working equipment control unit 26 and the display control unit 27. The sensor controller 24 calculates an inclination angle θ2 of the arm 432 relative to the boom 431, on the basis of the arm cylinder length detected by the arm cylinder stroke sensor 422, and outputs the inclination angle θ2 to the working equipment control unit 26 and the display control unit 27. The sensor controller 24 calculates an inclination angle θ3 of the tooth edge 440*p* of the bucket 440 included in the bucket 440 relative to the arm 432, on the basis of the bucket cylinder length detected by the bucket cylinder stroke sensor 423, and outputs the inclination angle θ3 to the working equipment control unit 26 and the display control unit 27. The inclination angles θ1, θ2, and θ3 can be detected by a sensor other than the boom cylinder stroke sensor 421, the arm cylinder stroke sensor 422, and the bucket cylinder stroke sensor 423. For example, an angle sensor such as a potentiometer can also detect the inclination angles θ1, θ2, and θ3. The sensor controller 24 calculates a relative position of the tooth edge 440*p* of the bucket 440 with respect to the vehicle body 400, on the basis of the inclination angle θ1, the inclination angle θ2, the inclination angle θ3, the length L1 of the boom 431, the length L2 of the arm 432, and the length L3 of the bucket 440.

The IMU 23 is connected to the sensor controller 24. The IMU 23 detects the vehicle body inclination information about the vehicle body such as the pitch around the Yg axis and the roll around the Xg axis of the excavator 2. The vehicle body inclination information about the vehicle body of the excavator 2 indicates an attitude of the vehicle body. The IMU 23 is mounted in the vehicle body 400 of the excavator 2.

The sensor controller 24 calculates an absolute position of the tooth edge 440*p* of the bucket 440 on the basis of the relative position of the tooth edge 440*p* of the bucket 440 with respect to the vehicle body 400 calculated by the sensor controller 24 and an absolute position of the vehicle body 400 acquired by the global coordinate calculation unit 22 and the IMU 23.

The controller 25 includes the working equipment control unit 26, the display control unit 27, and a communication unit 28.

The working equipment control unit 26 includes storage units such as RAM and ROM, and a processing unit such as CPU. On the basis of an amount of operation of the boom, an amount of operation of the bucket, and an amount of operation of the arm when the operator operates an operation unit, the working equipment control unit 26 controls the respective units of the working equipment.

The storage unit of the working equipment control unit 26 stores working equipment data about the excavator 2. The working equipment data includes the length of the boom, the length of the arm, and the length of the bucket. Furthermore, the working equipment data includes minimum and maximum values of the inclination angle of the boom, the inclination angle of the arm, and the inclination angle of the bucket. Each of the inclination angles is preferably calculated by a known method.

The display control unit 27 provides the operator with information for excavating the ground in the construction range and forming the ground into a shape as indicated by designed terrain data which is described later. The display control unit 27 includes storage units such as RAM and ROM, and a processing unit such as CPU. The display control unit 27 acquires the reference position data and the swing body orientation data that are the swing body arrangement data, from the global coordinate calculation unit 22. In the embodiment, the display control unit 27 generates bucket-tooth-edge position data that indicates a three-dimensional position of the tooth edge 440*p* of the bucket 440.

The designed terrain data is terrain data about a final shape of a work target, that is, the construction target in the embodiment, of the working equipment of the excavator 2. The work target of the working equipment is, for example, the ground. Examples of the work of the working equipment include, but are not limited to, excavation work and ground leveling work.

The display control unit 27 causes the display unit 29 to display as a guide screen, designed terrain data for the work target of the working equipment, on the basis of the designed terrain data acquired from the server device 10 described later. The display control unit 27 includes the communication unit 28. The communication unit 28 is communicable with an external communication device. The communication unit 28 receives current terrain data and the designed terrain data from the server device 10 or the like. The communication unit 28 may receive the current terrain data and the designed terrain data about the construction site 1000, from PC, a mobile terminal, or an external storage device such as a USB memory.

The guide screen is a screen that indicates a positional relationship between a cross-section of the designed terrain of the construction range and the bucket so that the operator readily recognizes the positional relationship therebetween. The guide screen provides the operator with information for operating the working equipment of the excavator 2 so that the ground as the work target has the same shape as that indicated by the cross-section of the designed terrain.

The display control unit 27 stores the designed terrain data created in advance in the construction company 1100. The designed terrain data is information about a shape and a position of a three-dimensional designed terrain. The designed terrain indicates the final shape of the ground as the work target. The display control unit 27 causes the displays the display unit 29 to display the guide screen on the basis of the designed terrain data and information such as the results of the detection from the various sensors described above.

The display control unit 27 displays an instruction to the excavator 2 acquired from a handoff instruction unit 15 of the server device 10. The instruction from the handoff instruction unit 15 will be described in detail later.

The display unit 29 is, for example, a liquid crystal display device that receives an input through a touch panel, but is not limited thereto.

<Second Work Machine>

Figure 6:
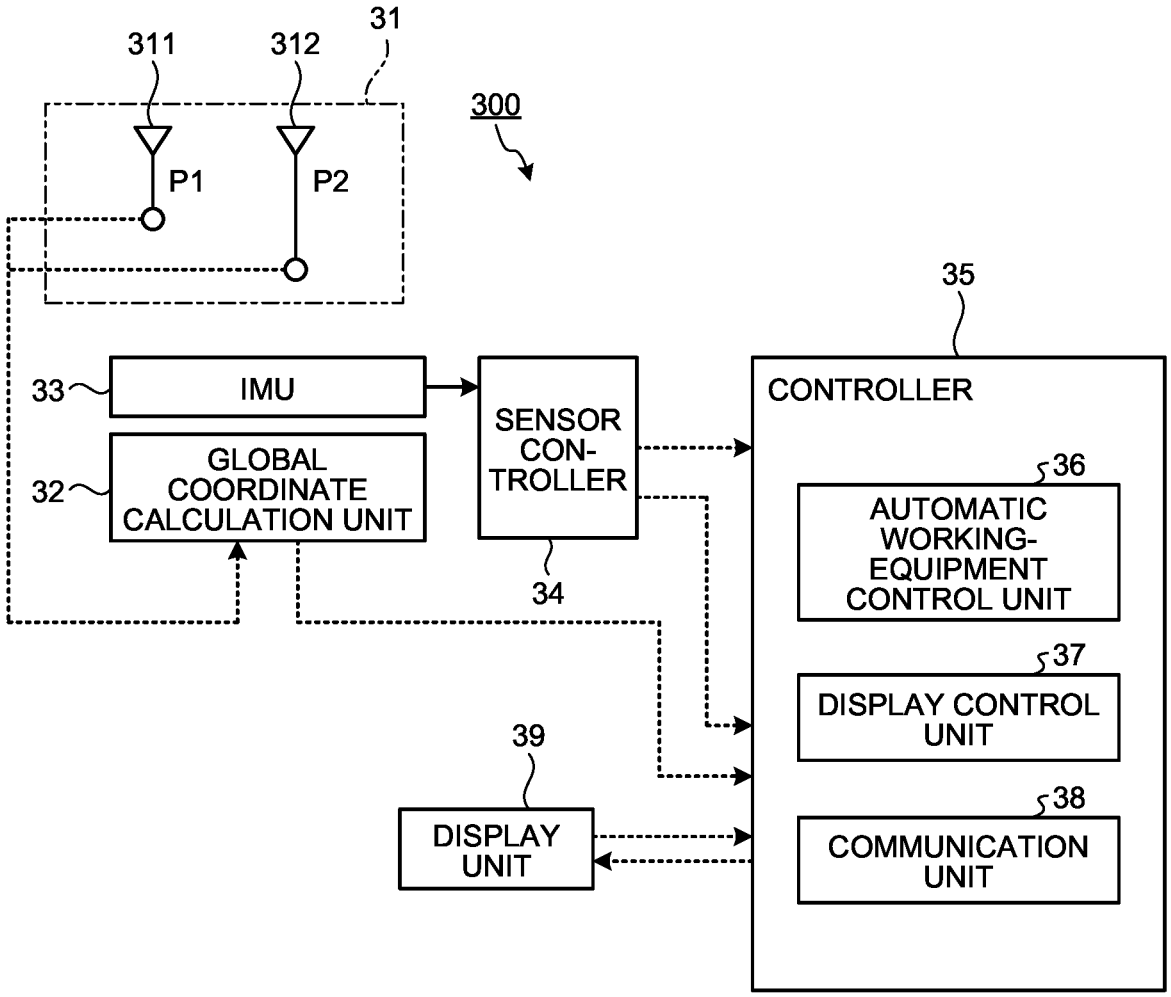
FIG. 6 is a block diagram illustrating an excavator as a second work machine according to the present embodiment.

FIG. 6 is a block diagram illustrating the excavator as the second work machine according to the present embodiment. The second work machine 3 is a work machine having the working equipment (second working equipment), such as an excavator, a bulldozer, or a wheel loader. The second work machine 3 has an automatic control function of automatically controlling working equipment on the basis of a current terrain and designed terrain of a construction range, and position information about the work machine. The second work machine 3 is automatically controllable to work instead of the excavator 2, on the basis of an instruction to the excavator 3, acquired from the handoff instruction unit 15 of the server device 10 which is described later. In the present embodiment, the excavator 3 will be described as an example of the second work machine. The excavator 3 includes a vehicle body and the working equipment. The excavator 3 has the automatic control function of automatically controlling the working equipment. The excavator 3 having the automatic control function for the working equipment makes it possible to perform construction highly accurately compared with that by the excavator 2 (first work machine). The excavator 3 includes an automatic working-equipment control unit 36 that automatically controls the working equipment on the basis of at least one of a current terrain and a designed terrain of the construction range and a tooth edge position of the working equipment.

In the present embodiment, the automatic control includes fully automatic control enabling unmanned construction and intervention control for intervention in operation by an operator. In the present embodiment, the excavator 3 will be described as having a fully automatic control function but is not limited thereto. The excavator 3 may have an intervention control function. In addition, the work machine is not limited to a type of work machine operated by the operator getting on the work machine and may be a type of work machine remotely operated by the operator not getting on the work machine.

The basic configuration of the excavator 3 is the same as that of the excavator 2, and therefore, description of configurations of the excavator 3 that are the same as those of the excavator 2 will be omitted.

The excavator 3 includes a control system 300 that includes a position detection device 31, a global coordinate calculation unit 32, an IMU 33, a sensor controller 34, a controller 35, and a display unit 39. The position detection device 31, the global coordinate calculation unit 32, the IMU 33, and the sensor controller 34 have similar configurations to those of the excavator 2.

The controller 35 includes the automatic working-equipment control unit 36, a display control unit 37, and a communication unit 38.

The automatic working-equipment control unit 36 includes storage units such as RAM and ROM, and a processing unit such as CPU. The automatic working-equipment control unit 36 causes the excavator 3 to work instead of the excavator 2, on the basis of an instruction to the excavator 3, acquired from the handoff instruction unit 15 of the server device 10 which is described later. The instruction from the handoff instruction unit 15 will be described in detail later.

The storage unit of the automatic working-equipment control unit 36 stores working equipment data about the excavator 3. The working equipment data includes a length of a boom, a length of an arm, and a length of a bucket. Furthermore, the working equipment data includes minimum and maximum values of an inclination angle of the boom, an inclination angle of the arm, and an inclination angle of the bucket. Each of the inclination angles is preferably calculated by a known method.

The automatic working-equipment control unit 36 acquires designed terrain data from the display control unit 37. The designed terrain data is information about the construction range that is a range in which the excavator 3 will work. The designed terrain data is data about the designed terrain which indicates a final shape of a work target of the working equipment. The designed terrain data is acquired from the server device 10 via the communication unit 38 and stored in the display control unit 37.

The automatic working-equipment control unit 36 calculates a position of the tooth edge of the bucket (hereinafter, appropriately referred to as tooth-edge position), on the basis of an angle of the working equipment acquired from the sensor controller 34. The automatic working-equipment control unit 36 automatically controls the operation of the working equipment on the basis of distance between the designed terrain data and the tooth edge of the bucket and speed of the working equipment so that the tooth edge of the bucket moves according to the designed terrain data. Note that as described above, the automatic control is not limited to the fully automatic control, and may be the intervention control for intervention in operation by the operator. The automatic working-equipment control unit 36 generates a boom command signal by using an amount of operation of the boom, an amount of operation of the arm, an amount of operation of the bucket, the designed terrain data acquired from the display control unit 37, bucket-tooth-edge position data, and an inclination angle acquired from the sensor controller 34, generates an arm command signal and a bucket command signal, if necessary, and drives various valves to control the working equipment.

The display control unit 37 displays information for excavating the ground in the construction range and forming the ground into a shape as indicated by the designed terrain data which is described later. The display control unit 37 includes storage units such as RAM and ROM, and a processing unit such as CPU. The display control unit 37 acquires the reference position data and the swing body orientation data that are the swing body arrangement data, from the global coordinate calculation unit 32. In the embodiment, the display control unit 37 generates the bucket-tooth-edge position data that indicates a three-dimensional position of the tooth edge of the bucket.

The display control unit 37 stores the designed terrain data created in advance. The designed terrain data is information about the shape and position of the three-dimensional designed terrain. The designed terrain indicates the final shape of the ground as the work target. The display control unit 37 may cause the display unit 39 to display a guide screen or the like on the basis of the designed terrain data and information such as the results of detection from the various sensors described above.

The display control unit 37 displays an instruction to the excavator 3 acquired from the handoff instruction unit 15 of the server device 10 which is described later.

The display unit 39 is, for example, a liquid crystal display device that receives an input through a touch panel, but is not limited thereto.

<Information Terminal>

In the construction company 1100, the information terminal 5 such as a personal computer is installed. In the construction company 1100, the designed terrain of the construction site 1000 is created. The designed terrain indicates the final shape of the ground in the construction site 1000. A worker of the construction company 1100 creates the designed terrain data two-dimensionally or three-dimensionally by using the information terminal 5.

<Server Device>

Figure 7:
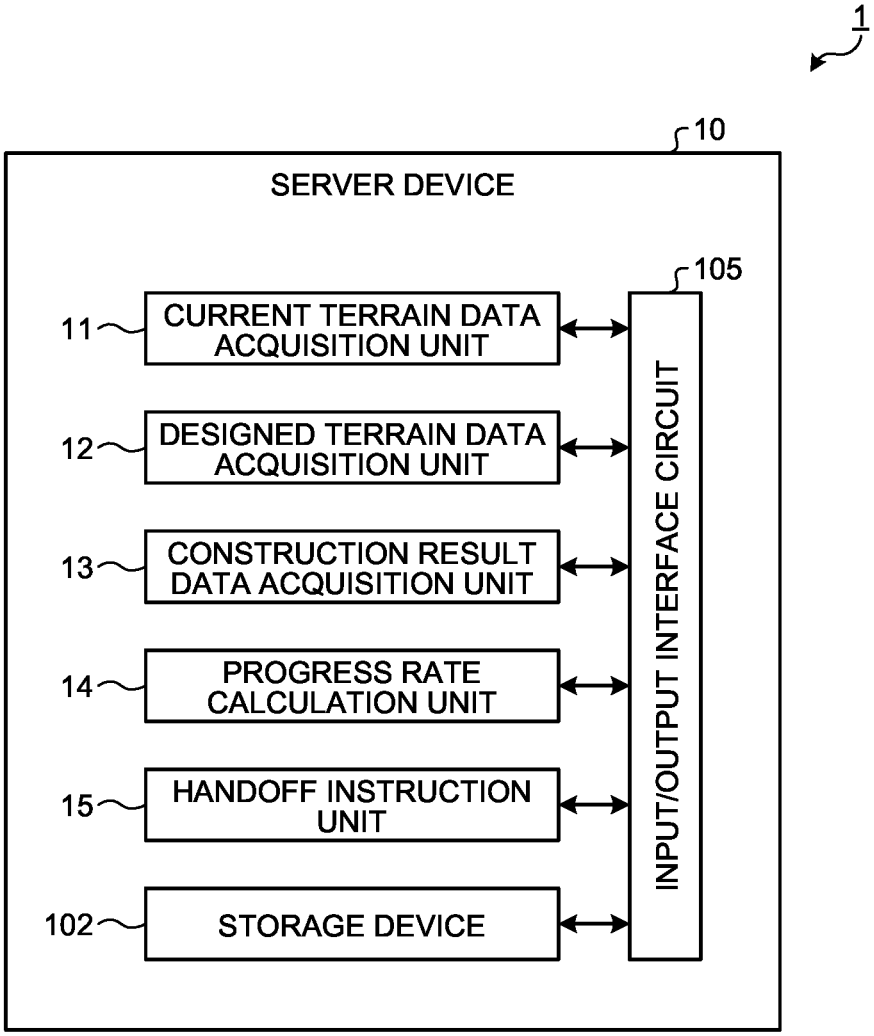
FIG. 7 is a block diagram illustrating a server device of the construction system according to the present embodiment.

FIG. 7 is a block diagram illustrating the server device of the construction system according to the present embodiment. The server device 10 is configured to perform data communication with the excavator 2 and the excavator 3 in the construction site 1000 through an input/output interface circuit 105. The server device 10 is configured to perform data communication with the construction company 1100 through the input/output interface circuit 105. The server device 10 includes a processor 101 that includes a current terrain data acquisition unit 11, a designed terrain data acquisition unit 12, a construction result data acquisition unit (acquisition unit) 13, a progress rate calculation unit 14, and the handoff instruction unit (instruction unit) 15.

The current terrain data acquisition unit 11 acquires the current terrain data indicating the current terrain of each construction range in the construction site 1000. The current terrain data is generated, for example, by measuring the current terrain of the construction range in the construction site 1000 by using a known measurement method. An example of the measurement method includes a method of measuring the current terrain by using the position information about a vehicle traveling in the construction site 1000, a method of measuring the current terrain by using position information about the tooth edge of the working equipment of the work machine such as the excavator 2 constructing the construction site 1000, a method of measuring the current terrain by running a surveying vehicle, a method of measuring the current terrain by using a stationary surveying instrument, a method of measuring the current terrain by using a stereo camera, a method of measuring the current terrain by using a three-dimensional laser scanner device, or a method of measuring the current terrain by using an unmanned aerial vehicle such as a drone. Note that the measurement by the unmanned aerial vehicle such as the drone may use a method of capturing an image of the current terrain by using, for example, a stereo camera and measuring the current terrain data on the basis of a result of the image capturing, or may use a method of measuring the current terrain data by using a three-dimensional laser scanner.

The designed terrain data acquisition unit 12 acquires the designed terrain data indicating the designed terrain of the construction site 1000. The designed terrain is created in the construction company 1100. The designed terrain data acquisition unit 12 acquires the designed terrain data from the construction company 1100 via communication means such as the Internet.

The construction result data acquisition unit 13 acquires construction result data about the working equipment of the excavator 2. The construction result data acquisition unit 13 acquires the construction result data indicating results of construction of the construction site 1000. The construction result data is data indicating the results of construction of the construction range in the construction site 1000 by the excavator 2. The excavator 2 acquires the construction result data about the excavator 2. The excavator 2 is configured to detect a terrain as the results of construction, on the basis of a trajectory of the absolute position of the tooth edge of the working equipment making contact with the current terrain or a travel trajectory of the undercarriage such as the crawler track or a wheel. In the work machine such as the excavator 2, the controller 25 is configured to compare the current terrain detected on the basis of the absolute position of the tooth edge with the designed terrain to calculate the construction result data indicating how much work has progressed (volume of soil having been excavated) with respect to the designed terrain. The construction result data acquisition unit 13 wirelessly acquires the construction result data from the excavator 2. Note that the income of the construction result data may be obtained by stereo camera measurement by an unmanned aerial vehicle such as a drone or by a three-dimensional laser scanner, with no use of the excavator.

The progress rate calculation unit 14 calculates a progress rate in the construction range for the excavator 2, on the basis of the designed terrain and the current terrain of the construction range for the excavator 2. For example, the progress rate calculation unit 14 may calculate the progress rate on the basis of a distance in cross-section between the designed terrain and the current terrain, that is, a difference in thickness of the ground in cross-sectional view. More specifically, the progress rate calculation unit 14 may calculate the progress rate, on the basis of a distance between a cross-section indicated by the current terrain data acquired by the current terrain data acquisition unit 11 and a cross-section indicated by the designed terrain data acquired by the designed terrain data acquisition unit 12.

Alternatively, for example, the progress rate calculation unit 14 may calculate, as the progress rate, a ratio of the volume of soil having been excavated by the excavator 2 to a target volume of soil to be excavated by the excavator 2 in the construction range. More specifically, the progress rate calculation unit 14 may calculate, as the progress rate, a ratio of the volume of soil having been excavated included in the construction result data acquired by the construction result data acquisition unit 13 to the target volume of soil.

The target volume of soil is a value obtained as an amount of soil being a difference between the current terrain and the designed terrain of the construction range, and is stored in a storage device 102 of the server device 10 which is described later. For example, in a case where the final shape of the construction range is set, the target volume of soil corresponding to the final shape is set. For example, in a case where a target shape for a predetermined period is set, the target volume of soil for the predetermined period may be set. For example, in a case where a daily target shape is set, a daily target volume of soil may be set.

The target volume of soil may be, for example, numerical data indicating a volume of earth and sand excavated in the construction range, represented by a numerical value, or image data indicating a volume of earth and sand excavated in the construction range.

The progress rate calculation unit 14 calculates a progress rate in the construction site 1000 on the basis of the current terrain data, the designed terrain data, and the construction result data. The progress rate calculation unit 14 calculates the progress rate for each construction range in the construction site 1000, that is, for each excavator 2. More specifically, the progress rate calculation unit 14 calculates the volume of soil having been excavated by the working equipment of the excavator 2 on the basis of the construction result data acquired by the construction result data acquisition unit 13. Then, the progress rate calculation unit 14 calculates a progress rate of construction by the working equipment of the excavator 2 on the basis of the target volume of soil stored in the storage device 102 of the server device 10 and the calculated volume of soil having been excavated.

On the basis of the designed terrain data, the handoff instruction unit 15 outputs a control signal for causing the excavator 3 as the second work machine to take over construction from the excavator 2 as the first work machine. More specifically, when the progress rate calculated by the progress rate calculation unit 14 is equal to or larger than a threshold, the handoff instruction unit 15 instructs the excavator 2 as the first work machine to stop construction of the construction range and to leave the construction range. In addition, the handoff instruction unit 15 instructs the excavator 3 as the second work machine to take over the construction of the construction range.

The threshold of the progress rate is preferably set for each excavator 2. For example, in a case where the final shape of the construction range is set, the threshold of the progress rate for the final shape is set. For example, in a case where the target shape for a predetermined period is set, the threshold of the progress rate for the target shape for the predetermined period is set. For example, in a case where a daily target shape is set, the threshold of the progress rate for the daily target shape is set. The threshold of the progress rate is configured to be set via an input device (input unit) 103 of the server device 10.

When a plurality of excavators 2 is determined to have the progress rate equal to or larger than the threshold, the handoff instruction unit 15 may instruct the excavator 3 to take over the construction of the construction range from the excavator 2 closest to the excavator 3.

<Hardware Configuration>

Figure 8:
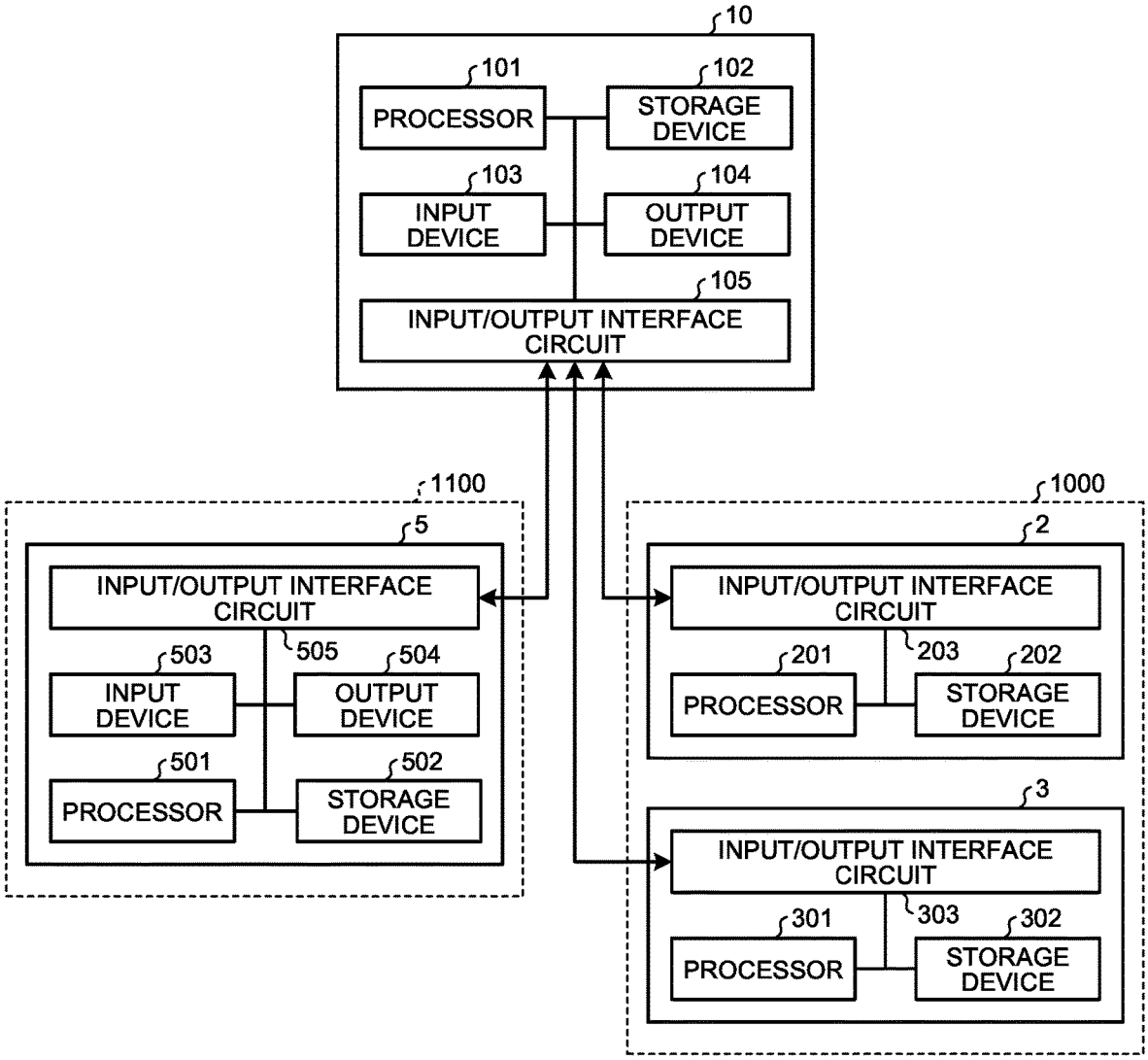
FIG. 8 is a block diagram illustrating the construction system according to the embodiment.

FIG. 8 is a block diagram illustrating the construction system according to the embodiment. The server device 10 includes the processor 101 such as CPU, the storage device 102 that includes an internal memory such as ROM or RAM and an external memory such as a hard disk device, the input device 103 that includes an input device such as a keyboard, mouse, and touch panel, an output device 104 that includes a display device such as a flat panel display device, and a printer such as an inkjet printer, and the input/output interface circuit 105 that includes a wired communication device or wireless communication device. The input device 103 is configured to receive an operation to input the threshold of the progress rate. The input threshold of the progress rate is stored in the storage device 102.

The excavator 2 operating in the construction site 1000 includes a processor 201, a storage device 202, and an input/output interface circuit 203 that includes a wired communication device or a wireless communication device.

The excavator 3 operating in the construction site 1000 includes a processor 301, a main memory 302, a storage 303, and an input/output interface circuit 304 that includes a wired communication device or a wireless communication device.

The information terminal 5 installed in the construction company 1100 includes a processor 501, a storage device 502, an input device 503, an output device 504, and an input/output interface circuit 505 that includes a wired communication device or a wireless communication device.

The server device 10 is configured to perform data communication with the excavator 2 and the excavator 3 in the construction site 1000. The excavator 2 and the excavator 3 perform wireless data communication with the server device 10 via a communication satellite or a mobile phone. Note that the excavator 2 and the excavator 3 may perform wireless data communication with the server device 10 by using another communication system such as wireless LAN including Wi-Fi.

The server device 10 is configured to perform data communication with the information terminal 5 in the construction company 1100. The information terminal 5 performs wireless data communication with the server device 10 via a communication satellite or a mobile phone. Note that the information terminal 5 may perform wireless data communication with the server device 10 by using another communication system such as wireless LAN including Wi-Fi.

<Construction Method>

Figure 9:
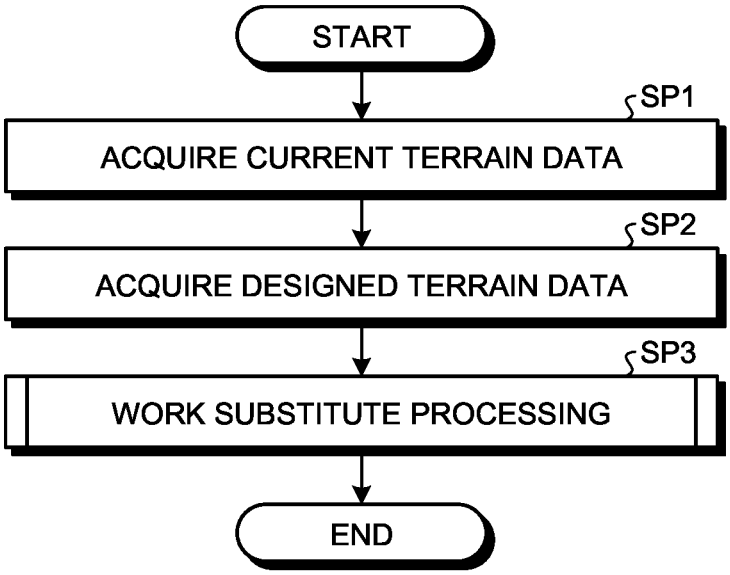
FIG. 9 is a flowchart illustrating an example of a construction method according to the present embodiment.
Figure 10:
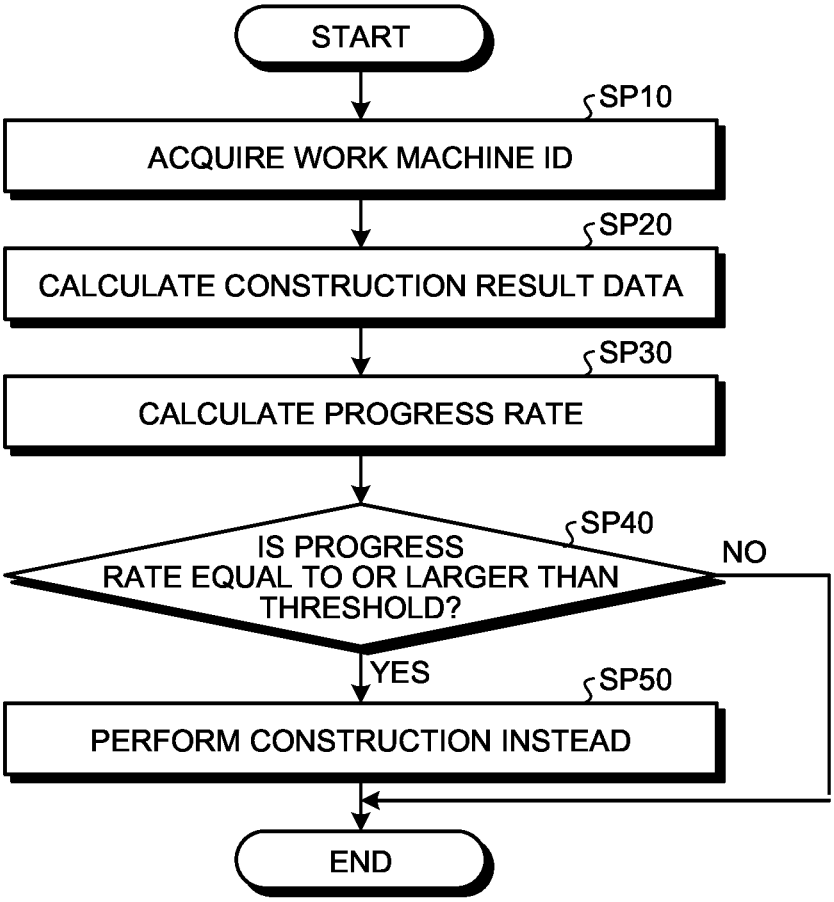
FIG. 10 is a flowchart illustrating an example of the construction method according to the present embodiment.

Next, the construction method using the construction system 1 will be described. FIG. 9 is a flowchart illustrating an example of the construction method according to the present embodiment. FIG. 10 is a flowchart illustrating an example of the construction method according to the present embodiment. In the present embodiment, the construction method uses the excavator 2 as the first work machine whose working equipment is operated by the operator, and the excavator 3 as the second work machine whose working equipment is automatically controlled. Here, the ratio of the volume of soil having been excavated to the target volume of soil to be excavated by the excavator 2 in the construction range is described as being calculated as the progress rate.

The server device 10 acquires the current terrain data indicating the current terrain of the construction site 1000 by the current terrain data acquisition unit 11 (Step SP1). The current terrain data can be measured using a known measurement method, and the measurement method is not limited.

The server device 10 acquires the designed terrain data indicating the designed terrain of the construction site 1000 from the construction company 1100 by using the designed terrain data acquisition unit 12 (Step SP2).

The server device 10 performs progress monitoring processing for all excavators 2 operating in the construction site 1000 (Step SP3). More specifically, the server device 10 performs the processing of Steps SP10 to SP50 for all excavators 2 operating in the construction site 1000, according to the flowchart illustrated in FIG. 10.

The server device 10 acquires a working equipment ID allowing identification of each excavator 2 and the position information about the excavator 2, from the excavator 2 (Step SP10). The working equipment ID can be acquired, for example, during communication between the server device 10 and the excavator 2. Note that, in a case where the construction range for the excavator 2 is set in advance and is known and the position of the excavator 2 can be estimated on the basis of the construction range, the acquisition of the position information may be omitted.

The server device 10 acquires the construction result data indicating the results of construction of the construction range for the excavator 2 in the construction site 1000, by using the construction result data acquisition unit 13 (Step SP20). A method of acquiring the construction result data is not limited.

The server device 10 calculates the progress rate in each construction range in the construction site 1000 on the basis of the current terrain data, the designed terrain data, and the construction result data, by using the progress rate calculation unit 14 (Step SP30). More specifically, the progress rate calculation unit 14 calculates the progress rate indicating the volume of soil having been excavated by the excavator 2 to the target volume of soil to be excavated by the excavator 2 in the construction range.

The server device 10 determines whether the progress rate calculated by the progress rate calculation unit 14 is equal to or larger than the threshold set for the excavator 2 (Step SP40). When it is determined that the progress rate is equal to or larger than the threshold (Yes in Step SP40), the process proceeds to Step SP50. When it is not determined that the progress rate is equal to or larger than the threshold (No in Step SP40), the process is finished.

When it is determined that the progress rate is equal to or larger than the threshold (Yes in Step SP40), the server device 10 causes the excavator 3 as the second work machine to perform construction instead of the excavator 2 as the first work machine, by using the handoff instruction unit 15 (Step SP50). More specifically, the handoff instruction unit 15 outputs a control signal instructing the excavator 2 to stop the construction of the construction range and to leave the construction range. The excavator 2 that has received the instruction from the handoff instruction unit 15 stops the construction of the construction range and leaves the construction range according to the operation by the operator. In addition, the handoff instruction unit 15 outputs, to the excavator 3, the control signal for instructing the excavator 3 to take over the construction of the construction range from the excavator 2. The excavator 3 having received the instruction from the handoff instruction unit 15 moves to the construction range, and performs construction of the construction range taken over from the excavator 2 while controlling the working equipment on the basis of the designed terrain data.

Effects

In the present embodiment, when the progress rate of the construction range for the excavator 2 is equal to or larger than the threshold, the excavator 2 stops the construction of the construction range, and the excavator 3 takes over the construction of the construction range from the excavator 2. In the present embodiment, in a step of finishing the construction range where the progress rate is equal to or larger than the threshold, it is possible for the excavator 3 configured to perform highly accurate construction to perform the construction instead. In this way, according to the present embodiment, it is possible to improve the efficiency of construction by using the excavator 2 having the guide display function and operated by the operator and the excavator 3 having the automatic control function.

In the present embodiment, the threshold of the progress rate is set for each excavator 2. According to the present embodiment, the excavator 3 is configured to perform construction instead at an appropriate timing, according to each excavator 2 arranged in the construction site 1000.

In the present embodiment, when a plurality of excavators 2 is determined to have the progress rate equal to or larger than the threshold, the excavator 3 may take over the construction of the construction range from the excavator 2 closest to the excavator 3. According to the present embodiment, construction efficiency in the construction site 1000 can be further improved.

Note that, in the present embodiment, when it is determined that the progress rate is equal to or larger than the threshold, the server device 10 may not only cause the excavator 3 as the second work machine to perform construction instead of the excavator 2 as the first work machine but also instruct a transport machine such as a dump truck to move to the vicinity of the construction range for the excavator 2. This configuration makes it possible to efficiently carry the excavated earth and sand generated in the construction by the excavator 2 by the transport machine.

Modifications

In the above description, one excavator 3 is used but the present invention is not limited thereto. A plurality of excavators 3 may be used. In this case, for example, an excavator 3 closest to an excavator 2 whose progress rate is determined to be equal to or larger than the threshold may be instructed to take over the construction from the excavator 2.

REFERENCE SIGNS LIST

1 CONSTRUCTION SYSTEM
10 SERVER DEVICE
11 CURRENT TERRAIN DATA ACQUISITION UNIT
12 DESIGNED TERRAIN DATA ACQUISITION UNIT
13 CONSTRUCTION RESULT DATA ACQUISITION UNIT (ACQUISITION UNIT)
14 PROGRESS RATE CALCULATION UNIT
15 HANDOFF INSTRUCTION UNIT (INSTRUCTION UNIT)
2 EXCAVATOR (FIRST WORK MACHINE)
21 POSITION DETECTION DEVICE
22 GLOBAL COORDINATE CALCULATION UNIT
23 IMU
24 SENSOR CONTROLLER
25 CONTROLLER
26 WORKING EQUIPMENT CONTROL UNIT
27 DISPLAY CONTROL UNIT
29 DISPLAY UNIT
3 EXCAVATOR (SECOND WORK MACHINE)
31 POSITION DETECTION DEVICE
32 GLOBAL COORDINATE CALCULATION UNIT
33 IMU
34 SENSOR CONTROLLER
35 CONTROLLER
36 AUTOMATIC WORKING-EQUIPMENT CONTROL UNIT

37 DISPLAY CONTROL UNIT
39 DISPLAY UNIT

The invention claimed is:

1. A construction method using:

a first work machine that is controlled by manual operation; and a second work machine configured for automatically controlling second working equipment based on at least one of a current terrain and a designed terrain of a construction range, and a tooth-edge position of the second working equipment, the construction method comprising:

calculating a progress rate in the construction range for the first work machine based on the current terrain and the designed terrain of the construction range for the first work machine; and when the progress rate is equal to or larger than a threshold, the first work machine stops construction of the construction range, and the second work machine takes over the construction of the construction range from the first work machine, wherein the second work machine automatically controls the operation of the second working equipment based on the distance between the cutting edge of the second working equipment and the design terrain, and the speed of the second working equipment so that the cutting edge of the second working equipment moves along the design terrain.

2. A construction system using:

a first work machine that is controlled by manual operation; and a second work machine that is a different work machine than the first work machine, configured for automatically controlling second working equipment based on at least one of a current terrain and a designed terrain of a construction range, and a tooth-edge position of the second working equipment, the construction system comprising:

a processor configured to:

store the designed terrain of the construction range for the first work machine;

acquire construction result data indicating a result of construction of the construction range for the first work machine;

calculate a progress rate of construction by the first work machine, based on the designed terrain of the construction range for the first work machine and the construction result data; and instruct the first work machine to stop construction of the construction range and instruct the second work machine to take over the construction of the construction range, when the calculated progress rate is equal to or larger than a threshold, wherein the second work machine automatically controls the operation of the second working equipment based on the distance between the cutting edge of the second working equipment and the design terrain, and the speed of the second working equipment so that the cutting edge of the second working equipment moves along the design terrain.

3. The construction system according to claim 2, wherein the processor is further configured to:

store a target volume of soil to be excavated by the first work machine, acquire operation information about the first work machine, and wherein a volume of soil having been excavated by the first work machine is calculated based on the operation information, and the progress rate of construction by the first work machine is calculated based on the target volume of soil and the volume of soil having been excavated.

4. The construction system according to claim 2, wherein the first work machine includes a display that displays a guide indicating at least one of the current terrain and the designed terrain of the construction range, and a tooth-edge position of first working equipment.

5. The construction system according to claim 2, wherein the first work machine has a guide display function of displaying a guide indicating at least one of the current terrain and the designed terrain of the construction range and a tooth-edge position of first working equipment.

6. The construction system according to claim 2, further comprising:

a plurality of the first work machines, and wherein the threshold of the progress rate is set for each of the first work machines.

7. The construction system according to claim 6, wherein when a plurality of respective first work machines of the plurality of first work machines are determined to have a respective progress rate equal to or larger than the threshold, the instruction unit instructs the second work machine to take over construction of a respective construction range from a respective first work machine closest to the second work machine.

8. The construction system according to claim 2, further comprising an input unit configured to receive an input of the threshold of the progress rate.

9. A construction system using:

a first work machine that is controlled by manual operation; and a second work machine different from the first work machine, includes a vehicle body and a second working equipment, and configured for automatically controlling the second working equipment based on at least one of a current terrain and a designed terrain of a construction range, and a tooth-edge position of the second working equipment, the construction system comprising:

a processor configured to:

store the designed terrain of the construction range for the first work machine;

acquire construction result data indicating a result of construction of the construction range for the first work machine;

calculate a progress rate of construction by the first work machine, based on the designed terrain of the construction range for the first work machine and the construction result data; and determine whether the calculated progress rate is above a threshold, and when the calculated progress rate is equal to or larger than the threshold, instruct the first work machine to stop construction of the construction range and instruct the second work machine to take over the construction of the construction range wherein the second work machine automatically controls the operation of the second working equipment based on the distance between the cutting edge of the second working equipment and the design terrain, and the speed of the second working equipment so that the cutting edge of the second working equipment moves along the design terrain.

* * * * *